US008586519B2

(12) United States Patent
Miller et al.

(10) Patent No.: US 8,586,519 B2
(45) **Date of Patent: *Nov. 19, 2013**

(54) MULTI-GRADE ENGINE OIL FORMULATIONS COMPRISING A BIO-DERIVED ESTER COMPONENT

(75) Inventors: Stephen Joseph Miller, San Francisco, CA (US); Saleh A. Elomari, Fairfield, CA (US); Zhen Zhou, Emeryville, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 27 days.

This patent is subject to a terminal disclaimer.

(21) Appl. No.: 12/548,191

(22) Filed: Aug. 26, 2009

(65) Prior Publication Data

US 2011/0053817 A1 Mar. 3, 2011

Related U.S. Application Data

(63) Continuation-in-part of application No. 11/673,879, filed on Feb. 12, 2007, now Pat. No. 7,871,967.

(51) Int. Cl.

| | |
|---|---|
| ***C10M 105/36*** | (2006.01) |
| ***C07C 55/02*** | (2006.01) |
| ***C07C 67/00*** | (2006.01) |

(52) U.S. Cl.
USPC ..... 508/496; 508/459; 508/506; 560/204

(58) Field of Classification Search
USPC ..... 508/496, 459, 506; 560/204
See application file for complete search history.

(56) References Cited

U.S. PATENT DOCUMENTS

| | | | |
|---|---|---|---|
| 2,079,403 | A | 5/1937 | Hansley |
| 2,492,201 | A | 12/1949 | Swern et al. |
| 2,537,283 | A | 1/1951 | Schaad et al. |
| 3,109,040 | A | 10/1963 | Lee |
| 3,211,801 | A | 10/1965 | Holm et al. |
| 3,270,085 | A | 8/1966 | Noddings et al. |
| 3,304,343 | A | 2/1967 | Mitsutani et al. |
| 3,317,465 | A | 5/1967 | Thomas et al. |

(Continued)

FOREIGN PATENT DOCUMENTS

| | | |
|---|---|---|
| DE | 19927979 | 10/2000 |
| DE | 102006021141 | 11/2007 |

(Continued)

OTHER PUBLICATIONS

U.S. Appl. No. 12/023,695, filed Jan. 31, 2008, Miller et al.

(Continued)

*Primary Examiner* — Cephia D Toomer
*Assistant Examiner* — Vishal Vasisth
(74) *Attorney, Agent, or Firm* — Jeffrey M. McQuiston; Edward Mickelson

(57) ABSTRACT

The present invention is generally directed to the present invention provides for multi-grade engine oil formulations comprising a diester component, wherein the diester component comprises vicinal diester species, and wherein at least a portion of said diester component is bio-derived. Many such formulations of the present invention are expected to favorably compete with similar, existing formulations comprising synthetic esters, but such formulations are generally expected to meet or exceed such existing formulations in a number of areas including, but not limited to, economics, biodegradability, and/or toxicity.

17 Claims, 6 Drawing Sheets

(56) References Cited

U.S. PATENT DOCUMENTS

| | | | | |
|---|---|---|---|---|
| 3,327,014 | A | 6/1967 | Noddings | |
| 3,393,225 | A | 7/1968 | Fenton | |
| 3,448,164 | A | 6/1969 | Holm et al. | |
| 3,489,775 | A | 1/1970 | de Roch et al. | |
| 3,723,564 | A | 3/1973 | Tidwell et al. | |
| 3,852,207 | A | 12/1974 | Stangeland et al. | |
| 4,017,429 | A | 4/1977 | Steele et al. | |
| 4,217,287 | A | 8/1980 | Wu et al. | |
| 4,474,940 | A | 10/1984 | Wilk et al. | |
| 4,554,397 | A | 11/1985 | Stern et al. | |
| 4,593,146 | A | 6/1986 | Johnson et al. | |
| 4,786,427 | A | 11/1988 | Dare-Edwards | |
| 4,880,937 | A | 11/1989 | Matsushita et al. | |
| 5,629,440 | A | 5/1997 | Camenzind et al. | |
| 5,798,054 | A | 8/1998 | Sato et al. | |
| 5,936,107 | A | 8/1999 | Raths et al. | |
| 5,939,366 | A | 8/1999 | MacNeil et al. | |
| 6,150,458 | A | 11/2000 | Weikard et al. | |
| 6,150,577 | A | 11/2000 | Miller et al. | |
| 6,165,952 | A | 12/2000 | Abramshe et al. | |
| 6,281,404 | B1 | 8/2001 | Miller | |
| 6,369,286 | B1 | 4/2002 | O'Rear | |
| 6,562,230 | B1 | 5/2003 | O'Rear et al. | |
| 6,566,568 | B1 | 5/2003 | Chen | |
| 6,703,353 | B1 | 3/2004 | Lok et al. | |
| 6,774,091 | B2 | 8/2004 | Dituro et al. | |
| 6,822,126 | B2 | 11/2004 | Miller | |
| 7,517,838 | B2 | 4/2009 | Kawahara et al. | |
| 7,544,645 | B2 | 6/2009 | Miller et al. | |
| 7,867,959 | B2 | 1/2011 | Miller et al. | |
| 7,871,967 | B2 | 1/2011 | Miller et al. | |
| 2006/0019840 | A1* | 1/2006 | Kawahara et al. | 508/280 |
| 2008/0194444 | A1 | 8/2008 | Miller et al. | |
| 2008/0248982 | A1 | 10/2008 | Miller et al. | |
| 2009/0149357 | A1 | 6/2009 | McGeehan | |
| 2009/0159837 | A1* | 6/2009 | Kramer et al. | 252/68 |
| 2009/0198075 | A1 | 8/2009 | Miller et al. | |
| 2009/0285728 | A1* | 11/2009 | Miller | 422/187 |
| 2010/0029523 | A1* | 2/2010 | Benecke et al. | 508/496 |
| 2010/0120642 | A1* | 5/2010 | Miller et al. | 508/465 |

FOREIGN PATENT DOCUMENTS

| | | |
|---|---|---|
| EP | 1529828 | 5/2005 |
| EP | 1717297 | 11/2006 |
| GB | 1031106 | 5/1966 |
| GB | 2328207 | 2/1999 |
| WO | 98/21170 | 5/1998 |

OTHER PUBLICATIONS

U.S. Appl. No. 12/270,235,filed Nov. 13, 2008, Miller et al.

Allen and Sprangler, "γ-Chloropropyl Acetate," Organic Syntheses, Coll. vol. 3, p. 203 (1955): vol. 29, p. 33 (1949).

Dornte, "Oxidation of White Oils," Industrial and Engineering Chemistry, vol. 28, pp. 26-30, 1936.

Dry, "The Fischer-Tropsch process: 1950-2000," Catalysis Today, vol. 71(3-4), pp. 227-241, 2002.

Eliel et al., "α-Chlorophenylacetic Acid," Organic Syntheses, Coll. vol. 4, p. 169 (1963): vol. 36, p. 3 (1956).

Fersht et al., "Acetylpyridinium ion intermediate in pyridine-catalyzed hydrolysis and acyl transfer reactions of acetic anhydride. Observation, kinetics, structure-reactivity correlations, and effects of concentrated salt solutions," J Am. Chem. Soc., vol. 92(18), pp. 5432-5442, 1970.

Höfle et al., "4-Dialkylaminopyradines as Highly Active Acylation Catalysts," Angew. Chem. Int. Ed. Engl., vol. 17, pp. 569-583, 1978.

Munch-Peterson, "3-Methylheptanoic Acid," Organic Syntheses, Coll. vol. 5, p. 762 (1973); vol. 41, p. 60 (1961).

Parker et al., "Mechanisms of Epoxide Reactions," Chem. Rev., vol. 59(4), pp. 737-799, 1959.

Paterson et al., "*meso* Epoxides in Asymmetric Synthesis: Enantioselective Opening by Nucleophiles in the Presence of Chiral Lewis Acids," Angew. Chem. Int. Ed., vol. 31(9), pp. 1179-1180, 1992.

Schroder, "Osmium tetraoxide cis hydroxylation of unsaturated substrates," Chem. Rev., vol. 80(2), pp. 187-213, 1980.

Schulz, "Short history and present trends of Fischer-Tropsch synthesis," Applied Catalysis A, vol. 186, pp. 3-12, 1999.

Sheldon and Kochi, in *Metal-Catalyzed Oxidation of Organic Compounds*, pp. 162-171 and 294-296 Academic Press, New York, 1981.

Swern, et al., "Epoxidation of Oleic Acid, Methyl Oleate and Oleyl Alcohol with Perbenzoic Acid," J. Am. Chem. Soc., vol. 66(11), pp. 1925-1927, 1944.

Bajpai et al., "Biodiesel: Source, Production, Composition, Properties and Its Benefits," J. Oleo Sci., vol. 55(10), p. 487-502, 2006.

Sargent et al., "Biosynthesis of Lipids in Zooplankton from Saanich Inlet, British Columbia, Canada," Marine Biology, vol. 31, p. 15-23, 1975.

Falk et al., "The Effect of Fatty Acid Composition on Biodiesel Oxidative Stability," Eur. Journal of Lipid Sci. & Techno!., vol. 106(12), p. 837-843, 2004.

Serimgeour, "Chemistry of Fatty Acids," in *Bailey 's Industrial Oil and Fat Products, 61 h Edition*, vol. 1, p. 1-43, F. Shahidi (Ed.), J. Wiley & Sons, New York, 2005.

Swern et al., "Epoxidation of Oleic Acid, Methyl Oleate and Oleyl Alcohol with Perbenzoic Acid," J. Am. Chern. Soc., vol. 66(11), p. 1925-1927, 1944.

Parker et al., "Mechanisms of Epoxide Reactions," Chern. Rev., vol. 59(4), p. 737-799, 1959.

Paterson et al., "*meso* Epoxides in Asymmetric Synthesis: Enantioselective Opening by Nucleophiles in the Presence of Chiral Lewis Acids," Angew. Chern. Int. Ed., vol. 31(9), p. 1179-1180, 1992.

Munich-Peterson, "3-Methylheptanoic Acid", Organic Syntheses, Coli. vol. 5, p. 762 (1973).

Allen et al., y-Chloropropyl Acetate, Organic Syntheses, Coli vol. 3 p. 203.

Eliel et al., a-Chlorophenylacetic Acid, Organic Syntheses, Coli. Vo. 4 p. 169 (1963).

M. Schroder, "Osmiumtetraoxide cis hydroxylation of unsaturated substrates," Chern. Rev., vol. 80(2), p. 187-213, 1980).

Sheldon and Kochi, in *Metal-Catalyzed Oxidation of Organic Compounds*, p. 162-171 and 294-296, Academic Press, New York, 1981).

Database CA [Online]; Chemical Abstracts Service, Columbus, Ohio, US; Kim, Jong Dae et al: "synthesis of 4,5-bis(hexanoyloxy)dodecane and its lubricating property", retrieved from STN, Database accession No. 1987:69869; & Kicho Kwahak Yongu (Yeungnam Taehakkyo) , 5, 129-35 Coden: KKWYDR, 1985.

Bried et al., "Synthetic Fluids from Branched Chain Diesters Physical and Chemical Properties of Pure Diesters" Industrial and Engineering Chemistry (Apr. 1947) 484-491.

Dmytryshyn et al., "Synthesis and characterization of vegetable oil derived esters: evaluation for their diesel additive properties", Bioresource Technology 92 (2004) 55-64.

Dry, The Fischer-Tropsch process; 1950-2000, Catalysis Today, vol. 71 (3-4) p. 227-241, 2002.

H. Schulz "Short history and present trends of Fischer-Tropsch synthesis" Applied catalysis A. vol. 186, p. 3-12 1999.

Dornte, "Oxidation of White Oils", Industrial and Engineering Chemistry, vol. 28, p. 26-3000, 1936.

Fersht et al., "Acetylpyridinium ion intermediate in pyridine-catalyzed hydrolysis and acyl transfer reactions of acetic anhydride. Observation, kinetics structure-reactivity correlations, and effects of concentrated salt solutions", J. Am. Chem. Soc. vol. 92 (18) p. 5432-5442, 1970.

Bilyk et al., "Nonvolatile alpha-branched chain fatty esters. II", Journal of the American Oil Chemists' Society, vol. 45 No. 6, Jun. 1968 , pp. 453-455.

Marshall et al., "Synthesis of a C22-34 Submit of the Immunosuppressant FK-506", The Journal of Organic Chemistry, vol. 60, No. 22, Nov. 1995, pp. 7230-7237, 55004500, ISSN 022-3263.

Database CA [Online] Chemical Abstracts Service, Columbus, Ohio, US; Lapkin et al, "Reaction of acylmagnesium halides with aromatic aldehydes", retrieved from STN. Database accession No. 1991;558659 and Izvestiya Vysshikh Uchebnykh Zavedeni, Khimiya Khimicheskaya Tekhnologiya, 34(5) 29-32CODEN.

(56) References Cited

OTHER PUBLICATIONS

Database CA [Online], Chemical Abstracts Service, Columbus, Ohio, US; Kamaev, et al., "Esters of fatty acids and glycols" retrieved from STN, database accession No. 1978:107654 & Neftepererabotka Neftekhimiy (Moscow, Russian Federation) (11), 40-1 Coden: NNNSAF; ISSN 0028-1190.

Sharpless et al., "Osmium Catalyst Vicinal hydroxylation of Olefins by tert-Butyl Hydroperoxide under Alkaline Conditions" J.AM. Chem.Soc. vol. 98 (7) p. 1986-1987.

Moser et al. "Diesters from Oleic Acid: Synthesis, Low Temperature Properties, and Oxidation Stability" J.AMer Oil Chem Soc (2007) 84: 675-680.

Holfe et al., "4-Dialkylaminopyradines as Highly Active Acylation Ctalysts", Angew Chem Int. Ed Engl. vol. 17 p. 569-589 1978.

U.S. Appl. No. 13/553,611, filed Jul. 19, 2012.

U.S. Appl. No. 13/553,658, filed Jul. 19, 2012.

U.S. Appl. No. 13/248,765, filed Sep. 29, 2011.

EP Search Report, Aug. 31, 2012, 7 pages.

Mirci, et al., New unsymmetrical complex diesters of adipic acid considered as tribological fluids, Lubrication Science 2010; 341-354.

Salimon, et al., Improvement of pour point and oxidative stability of synthetic ester basestocks for biolubricant applications, Arabian Journal of Chemistry (2012) 5, 193-200.

PCT/US08/53420 PCT Written Opinion of the International Search Authority, Jul. 30, 2008, 4 pages.

DE19927979A1 Oct. 12, 2000 Preparation of alkylenediol dicyclohexanoate, useful as nontoxic plasticizers, by hydrogenation of the dibenzoate over Group 8 metal catalyst on macroporous carrier (en) Abstract English Abstract.

PCT/US2009/043272, Written Opinion of the International Searching Authority, 5 pages.

PCT/US2010/0398809, Written Opinion of the International Searching Authority, Jan. 27, 2012, 3 pages.

DE102006021141A1 Nov. 8, 2007 New lubricants and pressure transmission meaon basis of Oleochemikalien, their production and use (en) Neue Schmierstoffe und Druckübertragungsmittel auf Basis von Oleochemikalien, deren Herstellung und Verwendung (de) Abstract English Abstract.

U.S. Appl. No. 12/498,663, filed Jul. 7, 2009.

U.S. Appl. No. 12/122,894, filed May 19, 2008.

U.S. Appl. No. 12/869,253, filed Aug. 26, 2010.

U.S. Appl. No. 11/673,879, filed Feb. 12, 2007.

U.S. Appl. No. 12/823,436, filed Jun. 25, 2010.

* cited by examiner

Table 1

| Multi-grade Engine Oil Formulation | Ester component = diisodecyl azelate | Ester component = isomeric mixture of diesters 3-9 |
|---|---|---|
| Kinematic Viscosity @ 100°C | 10.11 cSt | 10.04 cSt |
| Kinematic Viscosity @ 40°C | 48.98 cSt | 49.27 cSt |
| Viscosity Index (VI) | 200 | 197 |
| Cold Crank Simulator @ -35°C | 4,359 | 4,471 |
| Yield Stress | None | None |
| Apparent Viscosity, cP | 9,936 | 9,820 |
| Pour Point | < -60°C | -47°C |
| High Temp. High Shear (150°C), cP | 3.03 min. | 3.01 min. |
| Hot Tube @ 290°C: Lacquer Rating | 9 | 9 |

Fig. 5

Table 2

| Diester Mixture | VI | Vis. cSt (40°C) | Vis. cSt (100°C) | Pour Point °C | Cloud Point °C | Ox. BN |
|---|---|---|---|---|---|---|
| Diesters from C16 diol isomers and lauric acid | 152 | 24.4 | 5.2 | -19 | -18 | 38 hrs |
| Diesters from C16 diol isomers and C6-C10 carboxylic acids | 124 | 17.9 | 4 | -51 | -51 | 25.8 hrs |
| Diesters from C14 diol isomers and C6-C10 carboxylic acids | 109 | 16.3 | 3.6 | -66 | -69 | 19.5 hrs |

Fig. 6

MULTI-GRADE ENGINE OIL FORMULATIONS COMPRISING A BIO-DERIVED ESTER COMPONENT

This application is a CIP of Ser. No. 11/673,879, filed Feb. 12, 2007, now U.S. Pat. No. 7,871,967.

FIELD OF THE INVENTION

This invention relates to lubricant formulations, and specifically to multi-grade engine oils comprising a diester component—particularly wherein the diester component is at least partially derived from a biomass precursor.

BACKGROUND

Esters have long been used as lubricating oils. In fact, esters were the first synthetic crankcase motor oils in automotive applications. Today, they are used in a variety of lubricant applications ranging from jet engines to refrigeration.

Ester-based lubricants, in general, have excellent lubrication properties due to the polarity of the ester molecules of which they are comprised. The polar ester groups of such molecules adhere to positively-charged metal surfaces creating protective films which slow down the wear and tear of the metal surfaces. Such lubricants are less volatile than the traditional lubricants and tend to have much higher flash points and much lower vapor pressures. Ester-based lubricants are excellent solvents and dispersants, and can readily solvate and disperse the degradation by-products of oils, thereby reducing sludge buildup. While ester-based lubricants are relatively stable to thermal and oxidative processes, the ester functionalities give microbes a handle to do their biodegrading more efficiently and more effectively than their mineral oil-based analogues.

Production of such esters (i.e., esters suitable for use as lubricants), however, is generally more involved and considerably more costly than the preparation of their poly-alpha-olefin (PAO) counterparts. As a result, such esters tend to be blended with other base stocks (synthetic and/or non-synthetic) so as to advantageously impart at least some of their lubricant properties, but with more favorable overall economics.

Currently, a variety of commercially-available esters are available for such above-described application. These include mono-esters, diesters, phthalate esters, trimellitate esters, and polyol esters. These are all, however, either generally poor lubricants/lubricant additives (for one or more of a variety of reasons) or relatively expensive.

In view of the foregoing, a more economical lubricant formulation comprising a diester component, particularly wherein said component is at least partially derived from a renewable resource, would be highly desirable.

BRIEF DESCRIPTION OF THE INVENTION

The present invention is generally directed to lubricant formulations, and specifically to multi-grade engine oils comprising a diester component—particularly wherein the diester component is at least partially derived from a biomass precursor material. Typically, at least a majority of the diester species contained within the diester component are vicinal diester species.

In some embodiments, the present invention is directed to a multi-grade engine oil formulation, said formulation comprising: (a) a base oil component, said base oil component accounting for from at least about 40 wt % to at most about 80 wt. % of said formulation; (b) an additive component comprising a detergent inhibitor (DI) package and a viscosity index (VI) improver, said additive component collectively accounting for at most about 35 wt % of said formulation; and (c) a diester component, distinct from the additive component, comprising a quantity of at least one diester species, the diester species having the following structure:

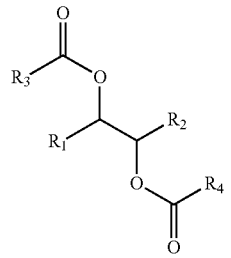

wherein $R_1$, $R_2$, $R_3$, and $R_4$ are the same or independently selected from $C_2$ to $C_{17}$, hydrocarbon groups, said at least one diester species accounting for at least about 30 wt % of said diester component, and wherein said diester component accounts for from at least about 5 wt % to at most about 35 wt % of said formulation; wherein said formulation has a kinematic viscosity of from between at least about 3 $mm^2/s$ (cSt) and at most about 15 $mm^2/s$ at 100° C., and a pour point of less than about −15° C.

In some such above-described embodiments, said multi-grade engine oil formulation has a viscosity index of from at least about 140 to at most about 300. In some or other such embodiments, the multi-grade engine oil formulation has a viscosity index of from at least about 140 to at most about 250. Additionally or alternatively, in some embodiments the above-described formulation has a kinematic viscosity of from between at least about 3 $mm^2/s$ and at most about 12 $mm^2/s$ at 100° C., and/or a pour point of less than about −20° C.

In some such above-described embodiments, the diester component of said multi-grade engine oil formulation comprises at least two different diester species. Such species can differ structurally (e.g., as isomers of one another), or they can have different chemical formulas with different carbon numbers.

The foregoing has outlined rather broadly the features of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which:

FIG. 5 (Table 1) compares the performance characteristics of a formulation of the present invention comprising bio-derived vicinal diesters with a multi-grade engine-oil formulation comprising a traditional ester additive; and FIG. 6 (Table 2) tabularizes the physical properties of three different diester mixtures, each suitable for use as/in the diester component in at least some formulation embodiments of the present invention.

DETAILED DESCRIPTION OF THE INVENTION

1. Introduction

Figure 1:
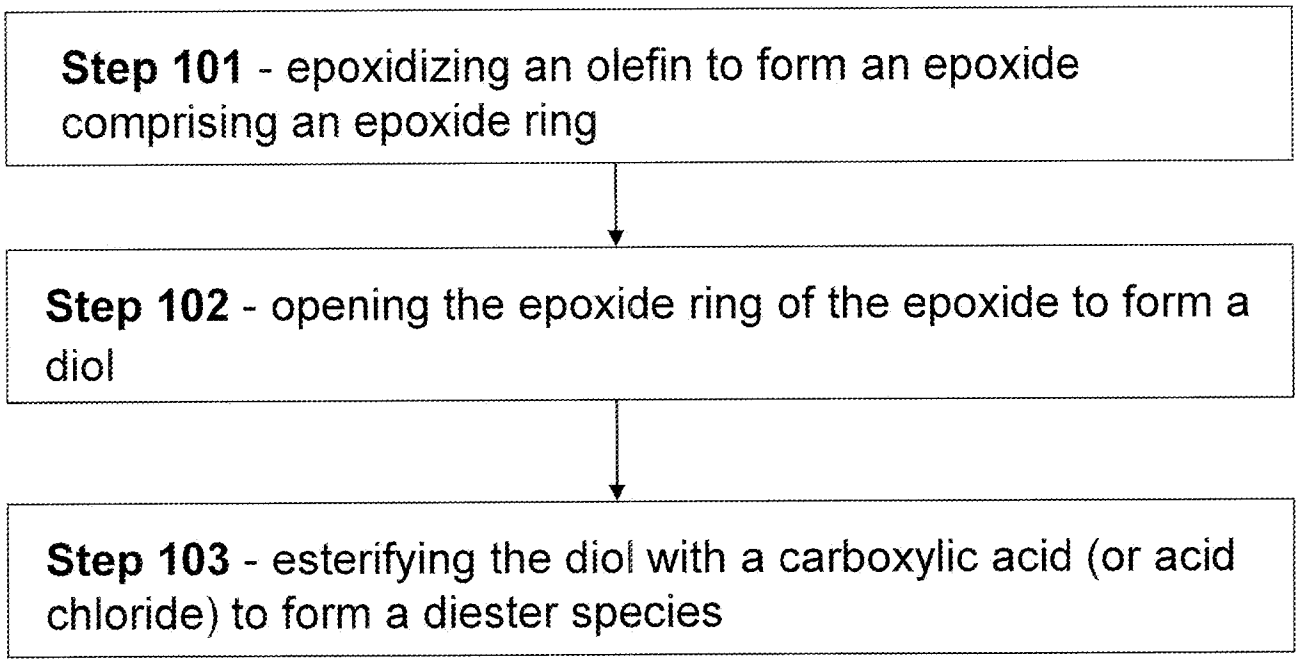
FIG. 1 is a flow diagram illustrating a method of making at least part of a diester component for use in at least some multi-grade engine oil formulations of the present invention.

To address at least some of the above-mentioned performance and/or cost considerations of existing lubricant formulations, the present invention is directed to multi-grade engine oil formulations comprising a diester component. Generally, at least a portion of the diester species (i.e., contained within the diester component of such a formulation) are vicinal diester species. Applicants are unaware of any pre-existing multi-grade engine oil formulations comprising such vicinal diesters.

In many of the embodiments, such above-mentioned formulations comprise at least one biologically-derived component (i.e., derived from biomass). To the extent that biomass is so utilized in producing any part of the overall lubricant formulation of the present invention, such lubricant formulations are deemed to be bio-derived. In some or other such embodiments, at least one component of said formulation is derived from a Fischer-Tropsch (F-T) process, as a product and/or by-product.

2. Definitions

"Lubricants," as defined herein, are substances (usually a fluid under operating conditions) introduced between two moving surfaces so to reduce the friction and wear between them. Base oils used as motor oils are generally classified by the American Petroleum Institute as being mineral oils (Group I, II, and III) or synthetic oils (Group IV and V). See American Petroleum Institute (API) Publication Number 1509.

"Pour point," as defined herein, represents the lowest temperature at which a fluid will pour or flow. See, e.g., ASTM Standard Test Method D 5950-02 (R 2007).

"Cloud point," as defined herein, represents the temperature at which a fluid begins to phase separate due to crystal formation. See, e.g., ASTM Standard Test Method D 5771-05.

"Centistoke," abbreviated "cSt," is a unit for kinematic viscosity of a fluid (e.g., a lubricant), wherein 1 centistoke equals 1 millimeter squared per second (1 cSt=1 $mm^2/s$). See, e.g., ASTM Standard Guide and Test Method D 2270-04. Herein, the units cSt and $mm^2/s$ are used interchangeably.

"Oxidation stability," as defined herein, generally refers to a composition's resistance to oxidation. Oxidator BN is a convenient way to measure the oxidation stability of base oils, and it is the method used to evaluate the oxidation stability of at least some of the lubricant compositions described herein. The Oxidator BN test is described by Stangeland et al. in U.S. Pat. No. 3,852,207. The Oxidator BN test measures an oil's resistance to oxidation by means of a Dornte-type oxygen absorption apparatus. See Dornte "Oxidation of White Oils," Industrial and Engineering Chemistry, vol. 28, pp. 26-30, 1936. Normally, the conditions are one atmosphere of pure oxygen at 340° F. (171° C.). The results are reported in hours to absorb 1000 m L, (1 L) of $O_2$ by 100 grams of oil.

With respect to describing molecules and/or molecular fragments herein, "$R_m$," where "in" is merely an identifier, refers to a hydrocarbon group, wherein the molecules and/or molecular fragments can be linear and/or branched, and unless stated otherwise, groups identified by different "m" identifiers can be the same or different.

As defined herein, "carbon number," as it relates to a hydrocarbon molecule or fragment (e.g., an alkyl group), is an integer denoting the total number of carbon atoms in the fragment or molecule. Carbon number with such a fragment or molecule can also be denoted as "$C_n$," or "Cn," where "n" is the total number of carbon atoms within that particular fragment or molecule.

The term "vicinal," as used herein, refers to the attachment of two functional groups (substituents) to adjacent carbons in a hydrocarbon-based molecule, e.g., vicinal diesters.

The prefix "bio," as used herein, refers to an association with a renewable resource of biological origin, such as resource generally being exclusive of fossil fuels. Such an association is typically that of derivation, i.e., a bio-ester derived from a biomass precursor material.

"Fischer-Tropsch products," as defined herein, refer to molecular species derived from a catalytically-driven reaction between CO and $H_2$ (i.e., "syngas"). See, e.g., Dry, "The Fischer-Tropsch process: 1950-2000," vol. 71(3-4), pp. 227-241, 2002; Schulz, "Short history and present trends of Fischer-Tropsch synthesis," Applied Catalysis A, vol. 186, pp. 3-12, 1999.

3. Diester Component

The diester component used in the multi-grade engine oil formulations of the present invention has been described in commonly-assigned U.S. patent application Ser. No. 11/673,879 (see also corresponding United States Patent Application Publication No. US 20080194444). Briefly, the diester component of the formulations of the present invention comprise a quantity of (vicinal) diester species having the following chemical structure:

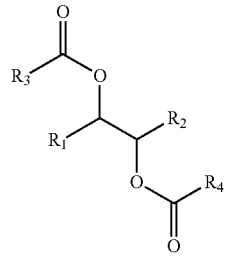

where $R_1$, $R_2$, $R_3$, and $R_4$ are the same or independently selected from a $C_2$ to $C_{17}$ carbon fragment.

Regarding the above-mentioned diester species, selection of $R_1$, $R_2$, $R_3$, and $R_4$ can follow any or all of several criteria. In some embodiments. $R_1$ and $R_2$ are selected to have a combined carbon number (i.e., total number of carbon atoms) of from 8 to 18. In these or other embodiments, $R_3$ and $R_4$ are selected to have a combined carbon number of from 10 to 34.

Depending on the embodiment, such resulting diester species can have a molecular mass between 280 atomic mass units (a.m.u.) and 840 a.m.u.

In some embodiments, above-described diester component is substantially homogeneous in terms of the diester species contained therein. In some or other embodiments, the diester component comprises a variety (i.e., a mixture) of diester species. In some such embodiments, at least some of the diesters in the diester component are at least partially bio-derived.

In some of the above-described embodiments, the diester component comprises diester species selected from the group consisting of decanoic acid 2-decanoyloxy-1-hexyl-octyl ester and its isomers, tetradecanoic acid-1-hexyl-2-tetradecanoyloxy-octyl esters and its isomers, dodecanoic acid 2-dodecanoyloxy-1-hexyl-octyl ester and its isomers, hexanoic acid 2-hexanoyloxy-1-hexyl-octyl ester and its isomers, octanoic acid 2-octanoyloxy-1-hexyl-octyl ester and its isomers, hexanoic acid 2-hexanoyloxy-1-pentyl-heptyl ester and isomers, octanoic acid 2-octanoyloxy-1-pentyl-heptyl ester and isomers, decanoic acid 2-decanoyloxy-1-pentyl-heptyl ester and isomers, decanoic acid-2-decanoyloxy-1-pentyl-heptyl ester and its isomers, dodecanoic acid-2-dodecanoyloxy-1-pentyl-heptyl ester and isomers, tetradecanoic acid 1-pentyl-2-tetradecanoyloxy-heptyl ester and isomers, tetradecanoic acid 1-butyl-2-tetradecanoyloxy-hexyl ester and isomers, dodecanoic acid-1-butyl-2-dodecanoyloxy-hexyl ester and isomers, decanoic acid 1-butyl-2-decanoyloxy-hexyl ester and isomers, octanoic acid 1-butyl-2-octanoyloxy-hexyl ester and isomers, hexanoic acid 1-butyl-2-hexanoyloxy-hexyl ester and isomers, tetradecanoic acid 1-propyl-2-tetradecanoyloxy-pentyl ester and isomers, dodecanoic acid 2-dodecanoyloxy-1-propyl-pentyl ester and isomers, decanoic acid 2-decanoyloxy-1-propyl-pentyl ester and isomers, octanoic acid 2-octanoyloxy-1-propyl-pentyl ester and isomers, hexanoic acid 2-hexanoyloxy-1-propyl-pentyl ester and isomers, and mixtures thereof.

4. Methods of Making the Diester Component

Methods of making the above-described vicinal diester compositions have been described in commonly-assigned U.S. patent application Ser. No. 11/673,879 (vide supra). Briefly, however, and with reference to the flow diagram shown in FIG. 1, in some embodiments, processes for making the above-mentioned diester species comprise the following steps: (Step 101) epoxidizing an olefin (or quantity of olefins) having a carbon number of from 8 to 16 to form an epoxide comprising an epoxide ring; (Step 102) opening the epoxide ring to form a diol; and (Step 103) esterifying (i.e. subjecting to esterification) the diol with an $C_2$ to $C_{18}$ carboxylic acid to form a diester species.

In some embodiments, the above-described diester component is substantially homogeneous in terms of the diester species contained therein. In some or other embodiments, and/or depending on the synthesis employed, the diester component comprises a variety (i.e., a mixture) of diester species. In some such embodiments, at least some of the diesters in the diester component are at least partially bio-derived, e.g., where the carboxylic acid (Step 103) is formed via the hydrolysis of crop oil-derived triglycerides.

In some such above-described embodiments, the olefin used (Step 101) is a reaction product of a Fischer-Tropsch process. In these or other embodiments, the carboxylic acid can be derived from alcohols generated by a Fischer-Tropsch process and/or it can be a bio-derived fatty acid.

In some embodiments the olefin is an α-olefin (i.e., an olefin having a double bond at a chain terminus). In such embodiments, it may be desirable to isomerize the olefin so as to internalize the double bond. Such isomerization is typically carried out catalytically using a catalyst such as, but not limited to, crystalline aluminosilicate and like materials and aluminophosphates. See, e.g., U.S. Pat. Nos. 2,537,283; 3,211,801; 3,270,085; 3,327,014; 3,304,343; 3,448,164; 4,593,146; 3,723,564 and 6,281,404; the last of which claims a crystalline aluminophosphate-based catalyst with 1-dimensional pores of size between 3.8 angstroms (Å) and 5 Å.

Figure 2:
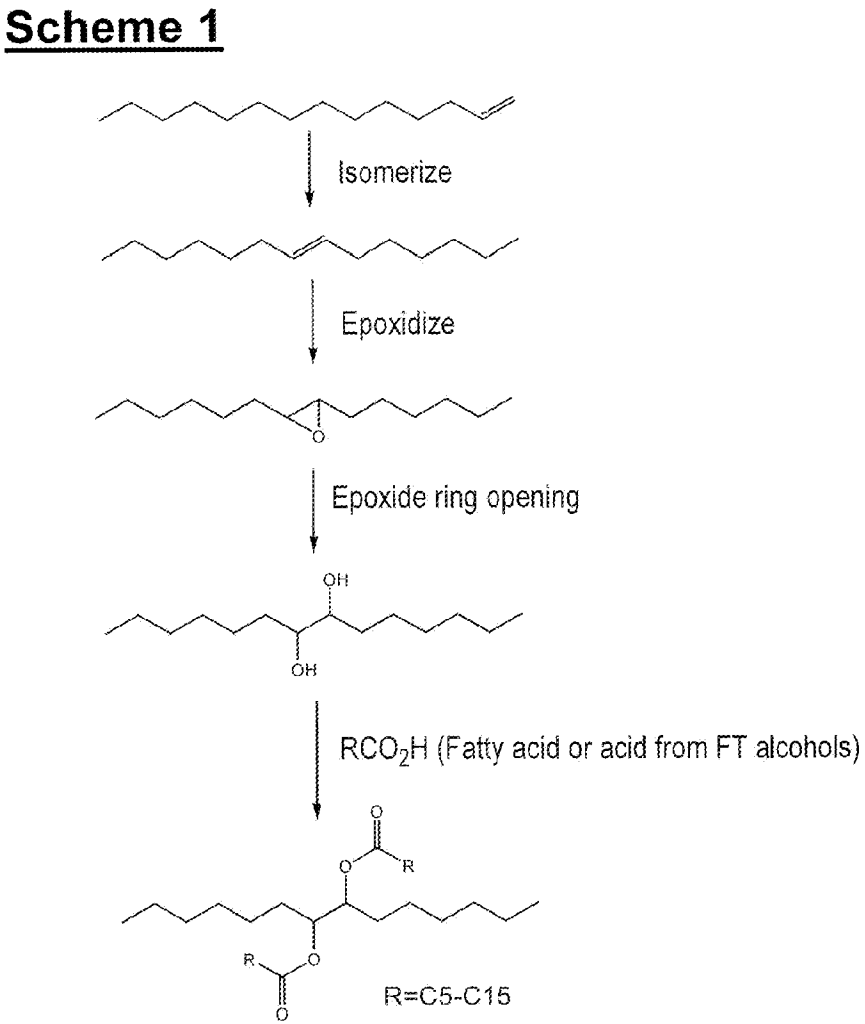
FIG. 2 (Scheme 1) is a chemical flow diagram illustrating an exemplary method of making diester species for the diester component, in accordance with some embodiments of the present invention.

As an example of such above-described isomerizing, and as indicated in Scheme 1 (FIG. 2), alpha (α) olefins (e.g., Fischer-Tropsch-derived α-olefins) can be isomerized to the corresponding internal olefins followed by epoxidation. The epoxides can then be transformed to the corresponding diols via epoxide ring opening followed by di-acylation (i.e., di-esterification) with the appropriate carboxylic acids or their acylating derivatives/analogues.

Regarding the step of epoxidizing (i.e., the epoxidation step), in some embodiments, the above-described olefin (preferably an internal olefin) can be reacted with a peroxide (e.g., $H_2O_2$) or a peroxy acid (e.g., peroxyacetic acid) to generate an epoxide. See, e.g., Swern et al., "Epoxidation of Oleic Acid, Methyl Oleate and Oleyl Alcohol with Perbenzoic Acid," J. Am. Chem. Soc., vol. 66(11), pp. 1925-1927, 1944. Olefins can be efficiently transformed to the corresponding diols by highly selective reagent such as osmium tetra-oxide (M. Schroder, "Osmium tetraoxide cis hydroxylation of unsaturated substrates," Chem. Rev. vol. 80(2), pp. 187-213, 1980) and potassium permanganate (Sheldon and Kochi, in *Metal-Catalyzed Oxidation of Organic. Compounds*, pp. 162-171 and 294-296, Academic Press, New York, 1981).

Regarding the step of epoxide ring opening to the corresponding diol, this step can be acid-catalyzed or based-catalyzed hydrolysis. Exemplary acid catalysts include, but are not limited to, mineral-based Brönsted acids (e.g., HCl, $H_2SO_4$, $H_3PO_4$, perhalogenates, etc.), Lewis acids (e.g., $TiCl_4$ and $AlCl_3$) solid acids such as acidic aluminas and silicas or their mixtures and the like. See, e.g., Parker et al., "Mechanisms of Epoxide Reactions," Chem. Rev. vol. 59(4), pp. 737-799, 1959; and Paterson et al., "meso Epoxides in Asymmetric Synthesis: Enantioselective Opening by Nucleophiles in the Presence of Chiral Lewis Acids," Angew. Chem. Int. Ed., vol. 31(9), pp. 1179-1180, 1992. Based-catalyzed hydrolysis typically involves the use of bases such as aqueous solutions of sodium or potassium hydroxide.

Regarding the step of esterifying (esterification), an acid is typically used to catalyze the reaction between the —OH groups of the diol and the carboxylic acid(s). Suitable acids include, but are not limited to, sulfuric acid (Munch-Peterson. Org. Synth. Coll. Vol. 5, p. 762, 1973), sulfonic acid (Allen and Sprangler, Org. Synth. Coll. Vol. 3, p. 203, 1955), hydrochloric acid (Eliel et al., Org. Synth. Coll. Vol. 4, p. 169, 1963), and phosphoric acid (among others). En some embodiments, the carboxylic acid used in this step is first converted to an acyl chloride (via, e.g., thionyl chloride or $PCl_3$). Alternatively, an acyl chloride could be employed directly. Wherein an acyl chloride is used, an acid catalyst is not needed and a base such as pyridine, 4-dimethylaminopyridine (DMAP) or triethylamine (TEA) is typically added to react with an HCl produced. When pyridine or DMAP is used, it is believed that these amines also act as a catalyst by forming a more reactive acylating intermediate. See, e.g., Fersht et al., "Acetylpyridinium ion intermediate in pyridine-catalyzed hydrolysis and acyl transfer reactions of acetic anhydride.

Observation, kinetics, structure-reactivity correlations, and effects of concentrated salt solutions," J. Am. Chem. Soc., vol. 92(18), pp. 5432-5442, 1970; and Höfle et al., "4-Dialkylaminopyradines as Highly Active Acylation Catalysts," Angew. Chem. Int. Ed. Engl. vol. 17, pp. 569-583, 1978.

Figure 3:
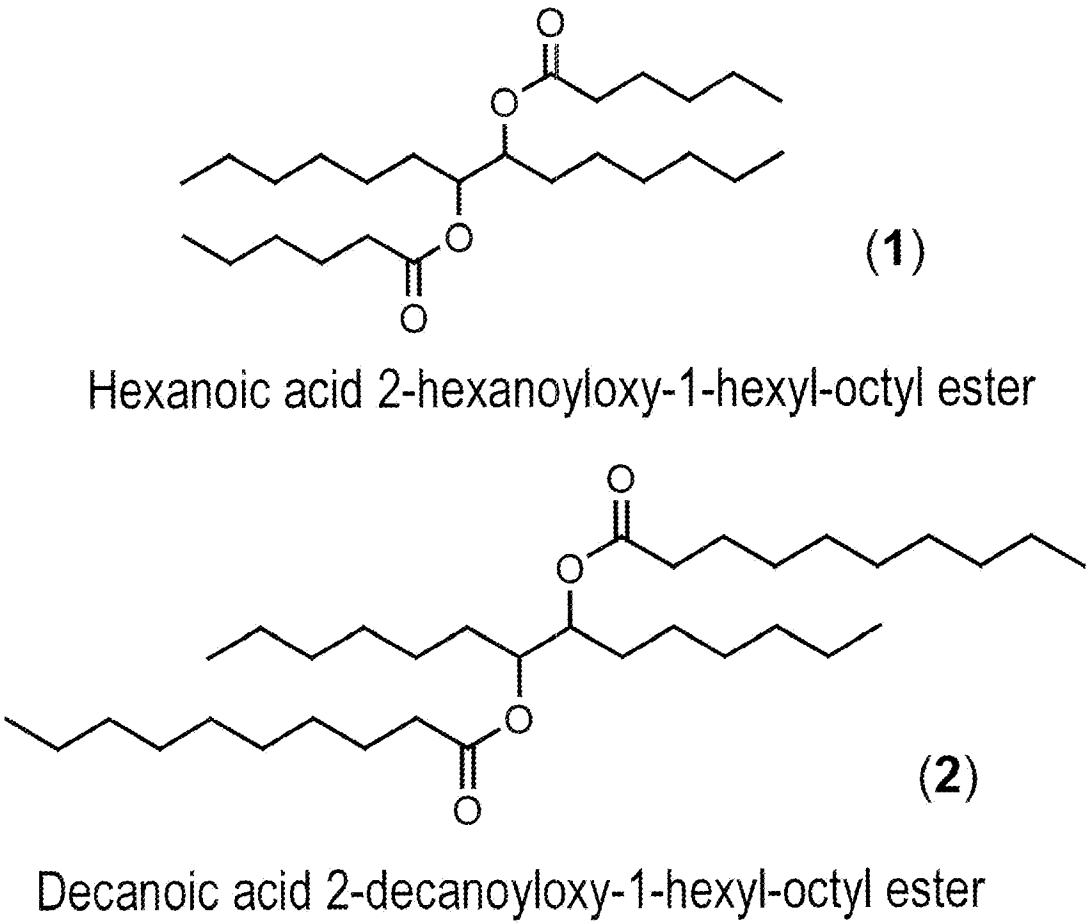
FIG. 3 depicts two exemplary diester compounds 1 and 2, suitable for use as the diester component (or as a component thereof) in at least some multi-grade engine oil formulations of the present invention.

Using a synthetic strategy in accordance with that outlined in Scheme 1 (FIG. 2), 7-tetradecene was converted to diester derivatives 1 and 2 via acylation of tetradecane-7,8-diol intermediate with hexanoyl and decanoyl chlorides, respectively, as shown in FIG. 3.

5. Multi-Grade Engine Oil Formulations

Generally, the multi-grade engine oils of the present invention comprise a diester component comprising vicinal diesters (such as described in Section 3 and 4 above). Accordingly, in some embodiments, the present invention is directed to a multi-grade engine oil formulation, said formulation comprising: (a) base oil component, said base oil component accounting for from at least about 40 wt. % to at most about 80 wt. % of said formulation; (b) an additive component comprising a detergent inhibitor (DI) package and a viscosity index (VI) improver, said additive component collectively accounting for at most about 35 wt % of said formulation; and (c) a diester component; distinct from the additive component, comprising a quantity of at least one vicinal diester species, the vicinal diester species having the following structure:

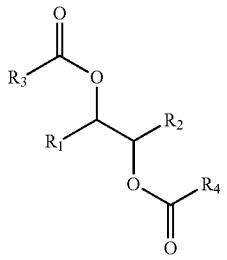

wherein $R_1$, $R_2$, $R_3$, and $R_4$ are the same or independently selected from $C_2$ to $C_{17}$ hydrocarbon groups, said at least one diester species accounting for at least about 30 wt % of said diester component, and wherein said diester component accounts for from at least about 5 wt % to at most about 35 wt % of said formulation; wherein said formulation has a kinematic viscosity of from between at least about 3 $mm^2/s$ and at most about 15 $mm^2/s$ at 100° C., and a pour point of less than about −15° C.

In some embodiments, the base oil component comprises a synthetic and/or non-synthetic base oil selected from Group I-V base oils (vide supra) or mixtures thereof. In some such above-described formulation embodiments, said base oil component comprises at least about 30 wt. % synthetic poly-alpha-olefin base oil. In some or other such embodiments, said base oil component comprises at least about 50 wt. % to at most about 80 wt. % base oil, and in some such embodiments the majority of said base oil is of the poly-alpha-olefin variety.

In some such above-described formulation embodiments, said formulation has a viscosity index (VI) of from at least about 140 to at most about 300. In some or other embodiments, said formulation has a viscosity index of from at least about 140 to at most about 250. In some or other such embodiments, the formulation has a kinematic viscosity of from at least about 3 $mm^2/s$ to at most about 12 $mm^2/s$ at 100° C., and/or a pour point of less than about −20° C.

Regarding the additive component, this component may comprise species in addition to the viscosity index improver and the detergent inhibitor package. In some or other embodiments, the additive component accounts for at most about 30 wt. % of said formulation.

Regarding the viscosity index improver, in some such above-described formulation embodiments, said viscosity index improver accounts for at least about 5 wt. % to at most about 50 wt. % of said additive component. In some such embodiments, the viscosity index improver comprises at least about 10 wt. % of one or more polyalkyl methacrylate species.

With regard to the detergent inhibitor package, such packages can include a detergent, an inhibitor, and (optionally) a dispersant and/or anti-wear additive. In some such above-described formulation embodiments, said detergent inhibitor package accounts for at least about 10 wt. % to at most about 90 wt. % of said additive component. In some or other such embodiments, said detergent inhibitor package accounts for at least about 20 wt. % to at most about 80 wt. % of said additive component. In some of either or other such embodiments, the detergent inhibitor package comprises at least about 10 wt. % of one or more detergent species and at least about 1 wt. % of one or more inhibitor species; and in some such embodiments, the detergent inhibitor package comprises at least about 15 wt. % of one or more detergent species and at least about 5 wt. % of one or more inhibitor species. See, e.g., U.S. patent application Ser. No. 12/000,183 (published as US 20090149357 A1), and U.S. Pat. No. 6,774,091.

Regarding the diester component, in some such above-described formulation embodiments, for the at least one diester species of which the diester component is at least partially comprised, $R_1$ and $R_2$ are selected to have a combined carbon number of from at least about 6 to at most about 14. Additionally or alternatively, in some such embodiments, for the at least one diester species of which the diester component is at least partially comprised, $R_3$ and $R_4$ are selected to have a combined carbon number of from at least about 10 to at most about 34.

In some such above-described formulation embodiments, the at least one diester species, of which the diester component is comprised, has an average molecular mass of from at least about 280 a.m.u. to at most about 840 a.m.u. In some or other such embodiments, the at least one diester species, of which the diester component is comprised, has an average molecular mass of from at least about 340 a.m.u. to at most about 780 a.m.u.

In some such above-described formulation embodiments, the at least one diester species of which the diester component is comprised, is selected from the group consisting of decanoic acid 2-decanoyloxy-1-hexyl-octyl ester and its isomers, tetradecanoic acid-1-hexyl-2-tetradecanoyloxy-octyl esters and its isomers, dodecanoic acid 2-dodecanoyloxy-1-hexyl-octyl ester and its isomers, hexanoic acid 2-hexanoyloxy-1-hexyl-octyl ester and its isomers, octanoic acid 2-octanoyloxy-1-hexyl-octyl ester and its isomers, hexanoic acid 2-hexanoyloxy-1-pentyl-heptyl ester and isomers, octanoic acid 2-octanoyloxy-1-pentyl-heptyl ester and isomers, decanoic acid 2-decanoyloxy-1-pentyl-heptyl ester and isomers, decanoic acid-2-decanoyloxy-1-pentyl-heptyl ester and its isomers, dodecanoic acid-2-dodecanoyloxy-1-pentyl-heptyl ester and isomers, tetradecanoic acid 1-pentyl-2-tetradecanoyloxy-heptyl ester and isomers, tetradecanoic acid 1-butyl-2-tetradecanoyloxy-hexyl ester and isomers, dodecanoic acid-1-butyl-2-dodecanoyloxy-hexyl ester and isomers, decanoic acid 1-butyl-2-decanoyloxy-hexyl ester and isomers, octanoic acid 1-butyl-2-octanoyloxy-hexyl ester and isomers, hexanoic acid 1-butyl-2-hexanoyloxy-hexyl ester and isomers, tetradecanoic acid 1-propyl-2-tetradecanoyloxy-pentyl ester and isomers, dodecanoic acid 2-dodecanoyloxy-1-propyl-pentyl ester and isomers, decanoic acid 2-decanoyloxy-1-propyl-pentyl ester and isomers, octanoic acid 2-octanoyloxy-1-propyl-pentyl ester and isomers, hexanoic acid 2-hexanoyloxy-1-propyl-pentyl ester and isomers, and mixtures thereof.

6. Formulation Preparation

Preparation of the Formulations Described in the Previous Section is typically carried out by mixing the associated components in ratios that produce formulations with specific properties. To further refine or calibrate the properties of a particular formulation, one or more additional additives may be incorporated into the formulation.

In some embodiments, in preparing the diesters used in the ester component, isomeric mixtures of diesters are employed. In such embodiments, the isomeric mixtures can be produced via synthetic pathways that utilize isomeric precursors (e.g., Examples 1 and 2, vide infra). In some or other embodiments, formulations of multi-grade engine oils are prepared by mixing ester mixtures that are individually homogeneous.

Economic considerations are often important in the preparation of such above-described multi-grade engine oil formulations. In some embodiments, the overall economics of such formulation (or components thereof) preparation can be enhanced through the utilization of existing resources (e.g., algae farms) and/or infrastructure (e.g., biodiesel production).

7. Variations

Variations on the above-described formulations and their manufacture include, but are not limited to, generating and/or utilizing compositional ranges and/or mixtures of diester species. See, e.g., Examples 1 and 2 (vide infra).

In some variational embodiments, molecular averaging can be employed to generate greater molecular homogeneity in the resulting compositions (at least in terms of the diester species contained therein). Such molecular averaging techniques typically involve olefin metathesis and are generally described in the following U.S. Pat. Nos. 6,566,568; 6,369,286; and 6,562,230.

In some variational embodiments, the diester molecules of the diester component are additionally or alternatively synthesized by a direct esterification of an epoxide intermediate, such as described in commonly-assigned U.S. patent application Ser. No. 12/023,695.

In some or other variational embodiments, at least some of the diester molecules of the diester component are additionally or alternatively synthesized using an enzymatic route. See, e.g., commonly-assigned U.S. patent application Ser. No. 12/270,235.

In some or still other variational embodiments, bio-derivation is introduced or otherwise provided via the olefins from which the diester species of the ester component are derived. In some such embodiments, bio-derived saturated and/or unsaturated fatty acids are decarboxylated to yield bio-derived olefins which can then be esterified as described in Section 4. See, e.g., U.S. Pat. Nos. 3,109,040 and 4,554,397.

8. Examples

The following examples are provided to demonstrate particular embodiments of the present invention. It should be appreciated by those of skill in the art that the methods disclosed in the examples which follow merely represent exemplary embodiments of the present invention. However, those of skill in the art should, in light of the present disclosure, appreciate that many changes can be made in the specific embodiments described and still obtain a like or similar result without departing from the spirit and scope of the present invention.

Example 1

This Example serves to illustrate synthesis of diols en route to synthesis of diester species suitable for use as/in the diester component, in accordance with some embodiments of the present invention.

In a 3-neck 3 L reaction flask equipped with an overhead stirrer and placed in an ice bath, 260 grams of 30% hydrogen peroxide (2.3 mol $H_2O_2$) was added to 650 grams of 88 wt. % formic acid (12.4 mol). To this mixture, 392 grams (2 mol) of a mixture of tetradecene isomers (i.e., a mixture of the following: 1-tetradecene, 2-tetradecene, 3-tetradecene, 4-tetradecene, 5-tetradecene, 6-tetradecene and 7-tetradecene) was added slowly over a 45-minute period via an addition funnel while ensuring that the reaction temperature stayed well below 45° C. Once the addition of the olefin was complete, the reaction was allowed to stir while cooling in an ice bath to prevent a rise in the temperature above 40-45° C., for 2 hrs. The ice bath was then removed and the reaction was stirred at room temperature overnight. The reaction mixture was concentrated with a rotary evaporator in a hot water bath at approx. 30 mmHg (Torr) to remove most of the water and formic acid. Then, 400 mL of ice-cold 1 M solution of sodium hydroxide was added very slowly (i.e., in small portions) and carefully to the remaining residue of the reaction. Once all the sodium hydroxide solution was added, the mixture was allowed to stir for an additional 2 hours at approx. 80° C. The mixture was then diluted with 500 mL ethyl acetate and transferred to a separatory funnel. The organic layer was separated and the aqueous layer was extracted 3 times with ethyl acetate (300 mL each). The ethyl acetate extracts were all combined and dried over anhydrous $MgSO_4$. Filtration, followed by concentration on a rotary evaporator at reduced pressure in a hot water bath yielded a tetradecenes-diol mixture (diol isomers prepared from the tetradecene isomers) as a waxy substance in 96% yield (443 grams). The tetradecenes-diols were characterized by infrared (IR) and nuclear magnetic resonance (NMR) spectroscopies, as well as gas-chromatography/mass spectrometry (GC/MS).

Example 2

This Example serves to illustrate the synthesis of diester species from the diol species prepared in Example 1, in accordance with some embodiments of the present invention.

Figure 4:
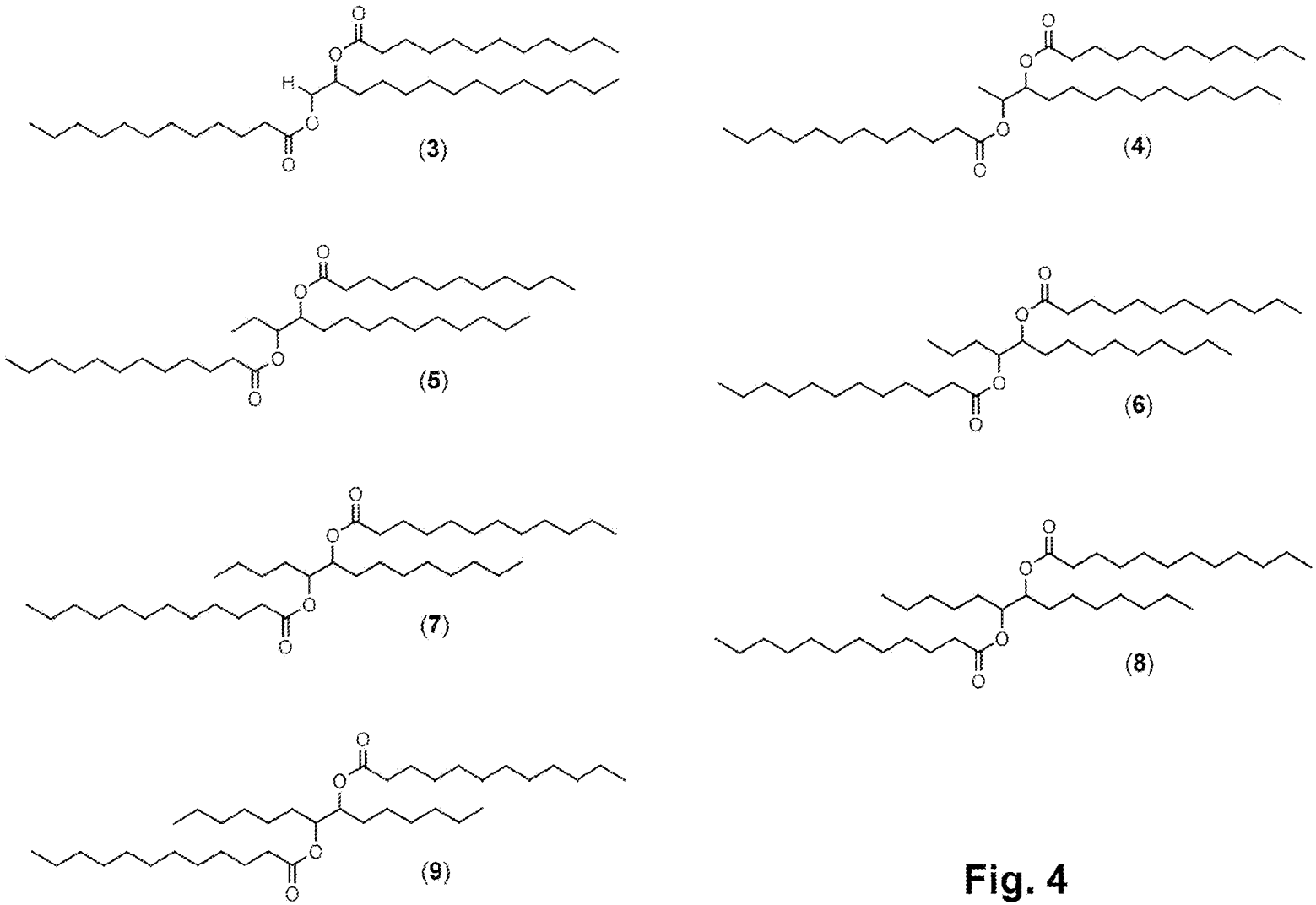
FIG. 4 depicts a mixture of diester compounds 3-9, made in accordance with some embodiments of the present invention.

In a 3-neck 1 L reaction flask equipped with an overhead stirrer, reflux condenser, and a dropping funnel, 440 grams (0.95 mol) of the tetradecenes-diol mixture (prepared above), 1148 grams (5.7 mol) lauric acid, and 17.5 grams of 85 wt. % $H_3PO_4$ (0.15 mol) were mixed. The resulting mixture was heated to 150° C. and stirred for several hours while monitoring the progress of the reaction by NMR spectral and GC/MS analysis. After stirring for 6 hours, the reaction was complete and the mixture cooled down to room temperature. The reaction mixture was washed with 1000 mL water and the organic layer was separated using a separatory funnel. The organic layer was further rinsed with brine solution (1000 mL of saturated sodium chloride solution). The resulting mixture was then distilled at 220° C. and 100 mmHg (Torr) to remove excess lauric acid. The diester product (the remaining residue in the distillation flask) was recovered as a faint yellow oil in 84% yield (1000 grams). The mixture of diesters (diester product) was hydrogenated to remove any residual olefins that may have formed by elimination during the esterification reaction. The colorless oil so obtained was analyzed by IR and NMR spectroscopies, and by GC/MS. Referring to FIG. 4, the mixture of diesters included the following isomers: tetradecene-1,2-diyl didodecanoate (3), tetradecene-2,3-diyl didodecanoate (4), tetradecene-3,4-diyl didodecanoate (5), tetradecene-4,5-diyl didodecanoate (6), tetradecene-5,6-diyl didodecanoate (7), tetradecene-6,7-diyl didodecanoate (8), and tetradecene-7,8-diyl didodecanoate (9).

Example 3

This Example serves to illustrate the formulation of a multi-grade engine oil, in accordance with some embodiments of the present invention.

A formulation was prepared by mixing the following ingredients in the following relative amounts (by weight): Chevron DELO 400 (61.89), Chevron Oronite OLOA 6194E (17.52), VISCOPLEX 6-985 (5.59), and the isomeric diester mixture prepared in Example 2 (15.00).

Regarding the above-listed formulation components, Chevron DELO 400 (Synfluid) is a synthetic poly-alpha-olefin (PAO) base oil (SAF 5W-30), OLOA 6194E is a detergent-inhibitor (DI) package made by Chevron Oronite (San Ramon, Calif.), and VISCOPLEX 6-985 is a viscosity index improver manufactured by Evonik RohMax Additives GmbH (Darmstadt, Germany).

Example 4

This Example serves to illustrate how the formulation produced in Example 3 compares to similar formulations that use an existing, commercially-available synthetic ester component.

Referring to Table 1 (FIG. 5), the formulation described in Example 3 above has been compared to a formulation of similar composition, but wherein the diester component has been replaced with SYNATIVE ES 2960, a commercial synthetic ester lubricant (diisodecyl azelate, a diester of azelaic acid) manufactured by Cognis Corp. (Cincinnati, Ohio). The properties of the two formulations are strikingly similar.

Example 5

This Example serves to illustrate the physical properties of various mixtures of vicinal diesters, suitable for use as/in the diester component of multi-grade engine oil formulations, in accordance with some embodiments of the present invention.

The diester species described herein are themselves capable of serving as lubricants, but are generally blended with other components to yield formulations such as those of the present invention. Such blending is often done for economic reasons (vide supra). Referring to Table 2 (FIG. 6), viscometric, low-temperature, and oxidation properties are tabulated for three different diester mixtures, such mixtures having been made in a manner such as described in Example 2 (i.e., from an isomeric diol mixture).

9. Summary

In summary, the present invention provides for multi-grade engine oil formulations comprising a diester component, wherein the diester component comprises vicinal diester species, and wherein at least a portion of said diester component is bio-derived. Many such formulations of the present invention are expected to favorably compete with similar, existing formulations comprising synthetic esters, but such formulations are generally expected to meet or exceed such existing formulations in a number of areas including, but not limited to, economics, biodegradability, and/or toxicity.

All patents and publications referenced herein are hereby incorporated by reference to an extent not inconsistent herewith. It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

What is claimed:

1. A multi-grade engine oil formulation comprising:

a) a base oil component, said base oil component accounting for at least about 40 wt. % to at most about 80 wt. % of said formulation;

b) an additive component comprising a viscosity index improver, said additive component collectively accounting for at most about 35 wt % of said formulation; and c) a diester component, distinct from the additive component, comprising a quantity of at least one vicinal diester species, where at least a majority fraction of the vicinal diester component is bio-derived, and wherein the vicinal diester species has the following structure:

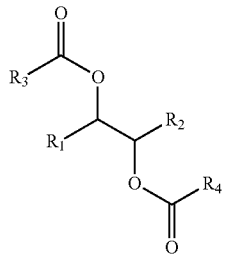

wherein $R_1$ and $R_2$ are independently selected from $C_5$ to $C_{17}$ hydrocarbon groups; and $R_3$ and $R_4$ are independently selected from $C_2$ to $C_{17}$ hydrocarbon groups, wherein said at least one diester species accounting for at least about 50 wt of said diester component, and wherein said formulation has a kinematic viscosity of between at least about 3 $mm^2/s$ at 100° C., and a pour point of less than about −20° C.

2. The formulation of claim 1, wherein said base oil component comprises at least about 30 wt. % synthetic polyalphaolefin base oil.

3. The formulation of claim 1, wherein said formulation has a viscosity index of at least about 140 to at most about 300.

4. The formulation of claim 1, wherein the viscosity index improver accounts for at least about 5 wt. % to at most about 50 wt. % of said additive component.

5. The formulation of claim 4, wherein the viscosity index improver comprises at least about 10 wt. % of one or more polyalkyl methacrylate species.

6. The formulation of claim 1, wherein the at least one vicinal diester species, of which the diester component is comprised, $R_1$ and $R_2$ are selected to have a combined carbon number of at least about 10 to at most about 14.

7. The formulation composition of claim 1, wherein the at least one vicinal diester species, of which the diester component is comprised, $R_3$ and $R_4$ are selected to have a combined carbon number of at least about 10 to at most about 34.

8. The formulation of claim 1, wherein the at least one vicinal diester species, of which the diester component is comprised, have an average molecular mass of at least about 280 a.m.u. to at most about 840 a.m.u.

9. The formulation of claim 1, wherein the at least one vicinal diester species is selected from the group consisting of decanoic acid 2-decanoyloxy-1-hexyl-octyl ester and its isomers, tetradecanoic acid-1-hexyl-2-tetradecanoyloxy-octyl esters and its isomers, dodecanoic acid 2-dodecanoyloxy-1-hexyl-octyl ester and its isomers, hexanoic acid 2-hexanoyloxy-1-hexyl-octyl ester and its isomers, octanoic acid 2-octanoyloxy-1-hexyl-octyl ester and its isomers, hexanoic acid 2-hexanoyloxy-1-pentyl-heptyl ester and isomers, octanoic acid 2-octanoyloxy-1-pentyl-heptyl ester and isomers, decanoic acid 2-decanoyloxy-1-pentyl-heptyl ester and isomers, decanoic acid-2-decanoyloxy-1-pentyl-heptyl ester and its isomers, dodecanoic acid-2-dodecanoyloxy-1-pentyl-heptyl ester and isomers, tetradecanoic acid 1-pentyl-2-tetradecanoyloxy-heptyl ester and isomers, tetradecanoic acid 1-butyl-2-tetradecanoyloxy-hexyl ester and isomers, dodecanoic acid-1-butyl-2-dodecanoyloxy-hexyl ester and isomers, decanoic acid 1-butyl-2-decanoyloxyhexyl ester and isomers, octanoic acid 1-butyl-2-octanoyloxy-hexyl ester and isomers, hexanoic acid 1-butyl-2-hexanoyloxy-hexyl ester and isomers, tetradecanoic acid 1-propyl-2-tetradecanoyloxy-pentyl ester and Isomers, dodecanoic acid 2-dodecanoyloxy-1-propyl-pentyl ester and isomers, decanoic acid 2-decanoyloxy-1-propyl-pentyl ester and isomers, octanoic acid 2-octanoyloxy-1-propyl-pentyl ester and isomers, and hexanoic acid 2-hexanoyloxy-1-propyl-pentyl ester and isomers, and mixtures thereof.

10. A multi-grade engine oil formulation comprising:

a) a synthetic base oil component comprising synthetic polyalphaolefins, said base oil component accounting for from at least about 50 wt. % to at most about 80 wt. % of said formulation;

b) an additive component comprising a viscosity index improver, said additive component collectively accounting for at most about 30 wt % of said formulation; and c) a diester component, distinct from the additive component, comprising a quantity of at least one vicinal diester species, wherein at least a majority fraction of the diester component is bio-derived, and wherein the vicinal diester species has the following structure:

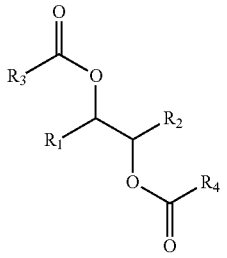

wherein $R_1$ and $R_2$ are independently selected from $C_5$ to $C_{17}$ hydrocarbon groups; and $R_3$ and $R_4$ are independently selected from $C_2$ to $C_{17}$ hydrocarbon groups, wherein the at least one diester species, of which the diester component is comprised, have an average molecular mass of from at least about 340 a.m.u. to at most about 780 a.m.u., wherein said at least one diester species accounting for at least about 50 wt of said diester component, and wherein said formulation has a kinematic viscosity of between at least about 3 $mm^2/s$ at 100° C., a viscosity index of at least about 140 to at most about 250, and a pour point of less than about −20° C.

11. The formulation of claim 10, wherein the at least one vicinal diester species, of which the diester component is comprised, $R_1$ and $R_2$ are selected to have a combined carbon number of at least about 10 to at most about 14, and wherein $R_3$ and $R_4$ are selected to have a combined carbon number of at least about 10 to at most about 34.

12. The formulation of claim 11, wherein the at least one vicinal diester species is selected from the group consisting of decanoic acid 2-decanoyloxy-1-hexyl-octyl ester and its isomers, tetradecanoic acid-1-hexyl-2-tetradecanoyloxy-octyl esters and its isomers, dodecanoic acid 2-dodecanoyloxyl-1-hexyl-octyl ester and its isomers, hexanoic acid 2-hexanoyloxy-1-hexyl-octyl ester and its isomers, octanoic acid 2-octanoyloxy-1-hexyl-octyl ester and its isomers, hexanoic acid 2-hexanoyloxy-1-pentyl-heptyl ester and isomers, octanoic acid 2-octanoyloxy-1-pentyl-heptyl ester and isomers, decanoic acid 2-decanoyloxy-1-pentyl-heptyl ester and isomers, decanoic acid-2-decanoyloxy-1-pentyl-heptyl ester and its isomers, dodecanoic acid-2-dodecanoyloxy-1-pentyl-heptyl ester and isomers, tetradecanoic acid 1-pentyl-2-tetradecanoyloxy-heptyl ester and isomers, tetradecanoic acid 1-butyl-2-tetradecanoyloxy-hexyl ester and isomers, dodecanoic acid-1-butyl-2-dodecanoyloxy-hexyl ester and isomers, decanoic acid 1-butyl-2-decanoyloxyhexyl ester and isomers, octanoic acid 1-butyl-2-octanoyloxy-hexyl ester and isomers, hexanoic acid 1-butyl-2-hexanoyloxy-hexyl ester and isomers, tetradecanoic acid 1-propyl-2-tetradecanoyloxy-pentyl ester and isomers, dodecanoic acid 2-dodecanoyloxy-1-propyl-pentyl ester and isomers, decanoic acid 2-decanoyloxy-1-propyl-pentyl ester and isomers, octanoic acid 2-octanoyloxy-1-propyl-pentyl ester and isomers, and hexanoic acid 2-hexanoyloxy-1-propyl-pentyl ester and isomers, and mixtures thereof.

13. A multi-grade engine oil formulation comprising:

a) a base oil component, said base oil component accounting for at least about 40 wt. % to at most about 80 wt. % of said formulation;

b) an additive component comprising a viscosity index improver, said additive component collectively accounting for at most about 35 wt % of said formulation; and c) a diester mixture comprising:
(3)
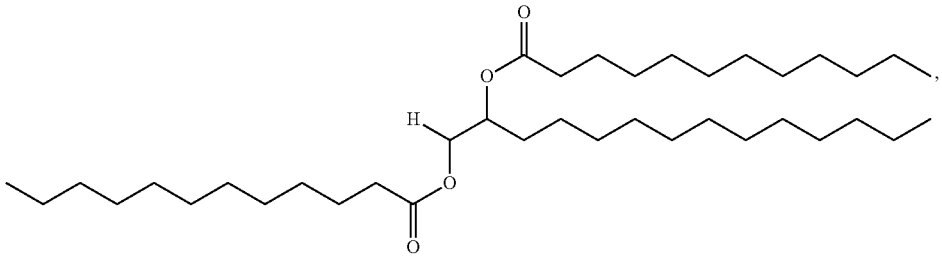
(4)
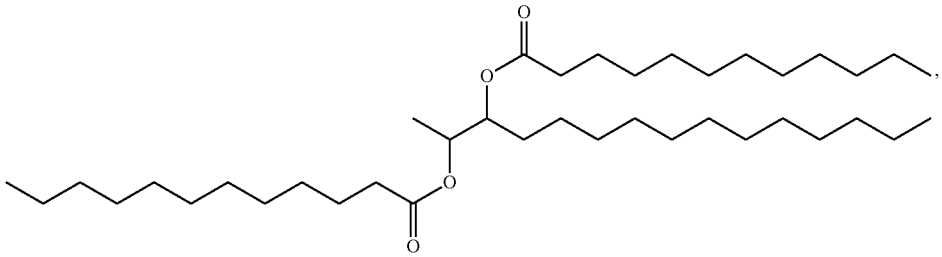
(5)
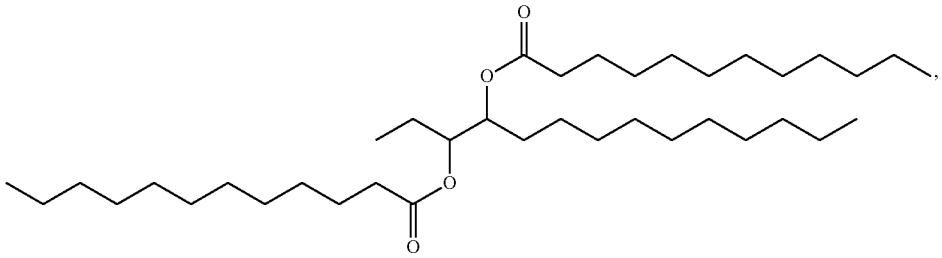
(6)
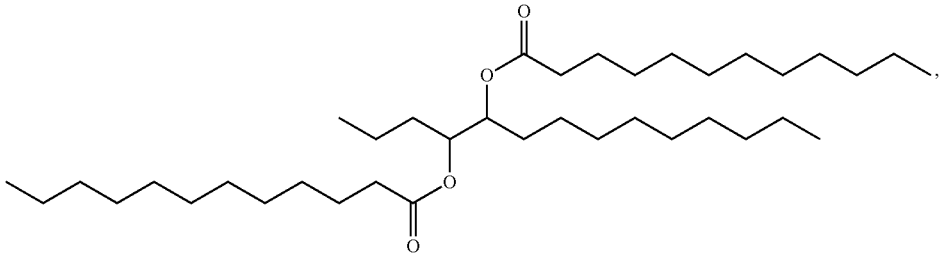
(7)
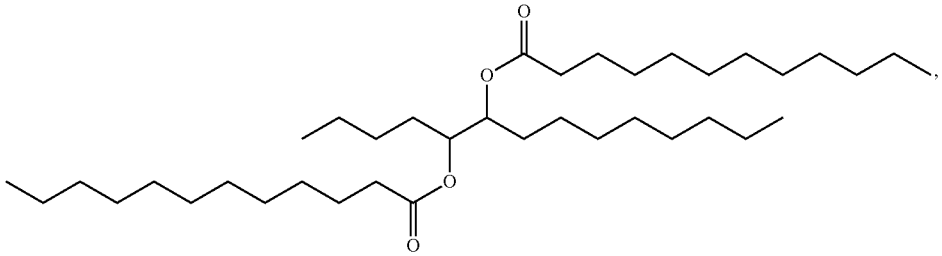
(8)
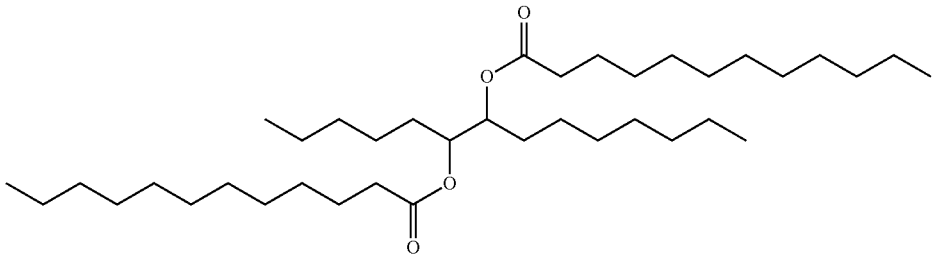
and -continued (9)

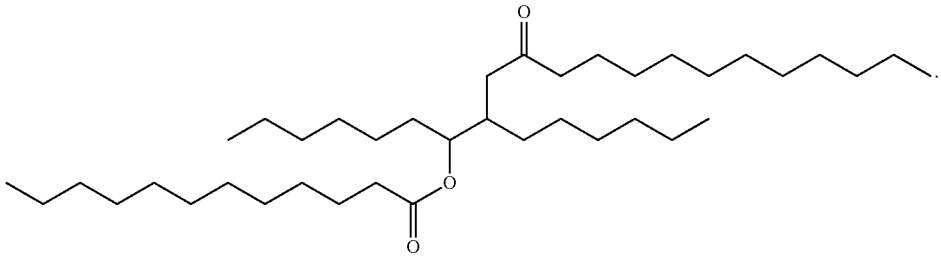

14. The formulation of claim 1, wherein the diester component comprises at least two different diester species.

15. The formulation of claim 10, wherein the diester component comprises at least two different diester species.

16. The formulation of claim 14, wherein the at least two vicinal diester species are isomers selected from the group consisting of tetradecene-1,2-diyl didodecanoate, tetradecene-2,3-diyldidodecanoate, tetradecene-3,4-diyldidodecanoate, tetradecene-4,5-diyldidodecanoate, tetradecene-5,6-diyldidodecanoate, tetradecene-6,7-diyl didodecanoate, and tetradecene-7,8-diyl didodecanoate.

17. The formulation of claim 15, wherein the at least two vicinal diester species are isomers selected from the group consisting of tetradecene-1,2-diyl didodecanoate, tetradecene-2,3-diyldidodecanoate, tetradecene-3,4-diyldidodecanoate, tetradecene-4,5-diyldidodecanoate, tetradecene-5,6-diyl didodecanoate, tetradecene-6,7-diyl didodecanoate, and tetradecene-7,8-diyldidodecanoate.

* * * * *